United States Patent [19]

Newton, Jr.

[11] 4,292,770

[45] Oct. 6, 1981

[54] YARN HEATER TRACK CLEANING APPARATUS AND METHOD

[75] Inventor: John C. Newton, Jr., Shelby, N.C.

[73] Assignee: Ansley, Incorporated, Shelby, N.C.

[21] Appl. No.: 130,819

[22] Filed: Mar. 17, 1980

[51] Int. Cl.[3] ..... B24B 23/02; B24B 1/00

[52] U.S. Cl. ..... 51/170 PT; 51/281 R; 51/267

[58] Field of Search ..... 51/170 PT, 170 R, 356, 51/266, 267, 268, 269, 272, 134.5 F, 241 LG, 281 R; 125/13 R

[56] References Cited

U.S. PATENT DOCUMENTS

| | | | |
|---|---|---|---|
| 1,063,380 | 6/1913 | Peirce | 125/13 |
| 1,765,890 | 6/1930 | Vates | 51/267 |
| 1,971,790 | 8/1934 | Mall | 51/267 |
| 2,239,845 | 4/1941 | Gibbons et al. | 51/267 |
| 2,857,671 | 10/1958 | Nelson | 51/267 |
| 3,585,980 | 6/1971 | Mellor | 51/273 |

FOREIGN PATENT DOCUMENTS

| | | | |
|---|---|---|---|
| 4165 | of 1927 | Australia | 51/134.5 F |

OTHER PUBLICATIONS

Fitzsimmons et al., Temperature Controlled Spray Mist Application in Matching Operations, Jan. 1975, Western Electric Tech. Digest No. 37, p. 9.

*Primary Examiner*—Roscoe V. Parker

*Attorney, Agent, or Firm*—Bell, Seltzer, Park & Gibson

[57] ABSTRACT

An apparatus and method for cleaning and polishing the yarn heater track of a yarn processing machine which includes guiding a rotating abrasion wheel along the yarn heater slot to dislodge the accumulated deposits and while simultaneously directing a fluid stream or mist into the slot to aid in removal of the dislodged deposits from the slot. The apparatus is portable and can be easily moved from one yarn processing station to the next station of a yarn processing machine and can be operated without requiring a drastic reduction in the amount of heat in the heater block.

7 Claims, 6 Drawing Figures

YARN HEATER TRACK CLEANING APPARATUS AND METHOD

FIELD OF THE INVENTION

This invention relates generally to an apparatus and method for cleaning accumulated deposits from the yarn heaters of yarn processing machines of the type wherein each yarn passes through a relatively narrow elongated yarn heating slot, and more particularly to the cleaning of such slots by guiding a rotating abrasion wheel along the elongated yarn heater slots through which the yarn passes and simultaneously directing a fluid stream or mist into the slots to aid in removal of the deoposits from the slots.

BACKGROUND OF THE INVENTION

Running yarn is subjected to a heating operation in several different types of textile machines, such as a yarn texturing machine of the false twist type. In this type of machine, a series of adjacent false twist stations is provided along each side of the machine and the yarn is heated as it passes through an elongated slot or track in a heater element at each station. The yarn is usually provided with a coating or application of size, lubricant or the like, and when subjected to the heating operation, the coating material is partially evaporated and/or softened so that some of the coating material is removed and accumulated deposits build up on the sidewalls and bottom of the slot. In many instances these deposits build up to an amount sufficient to change the amount of heat applied to the yarn and may change the tension in the yarn. This change in tension or change in friction against the yarn can change the dye affinity of the yarn. Also, these deposits may be dislodged and integrated in the yarn passing along the slot. In addition, certain deposits harden and tend to nick or tenderize the yarn and in extreme cases will even break the strand of yarn.

Textile machines of this type must be periodically stopped and the heater blocks allowed to cool before the yarn heater slots can be cleaned. This cleaning operation usually includes manually scraping each slot with a brass probe, a metal brush or the like, applying a cleaning fluid, and wiping with rags or the like. This is a slow and costly operation and can result in damage to the heater slots and/or nonuniform cleaning of adjacent slots. The cooling and reheating of the heater blocks can also decrease the life of the heater blocks and waste energy.

SUMMARY OF THE INVENTION

With the foregoing in mind, it is an object of the present invention to provide an apparatus and method for uniformly cleaning and polishing yarn heater slots in a fast and efficient manner and while not requiring any substantial reduction in the amount of heat being supplied to the heater blocks.

In accordance with the present invention, the apparatus is portable and can be easily moved by the cleaning operator from one yarn processing station to the next. The apparatus includes an abrasion wheel with an outer peripheral surface which can be shaped to conform to the configuration of the yarn heating slot. The rotating abrasion wheel removes the deposits and also polishes and deburrs the yarn heater slots. A handle supports an air motor for rotating the abrasion wheel and fluid directing means is supported adjacent the abrasion wheel for simultaneously directing a fluid stream into the slot at the point where the abrasion wheel meets the track and in the direction of rotation of the abrasion wheel to aid in removal of the deposits from the slot. Guard plates are provided to surround and cover the major portion of the periphery of the abrasion wheel. The fluid stream preferably includes a mixture of air and liquid which is sprayed into the yarn heating slot while the abrasion wheel is rotating in the slot. The combination of air and liquid into the spray nozzle allows selections ranging from a forceful stream of liquid down to a fine mist. Control valves on the handle make these selections possible while cleaning the slot.

The present cleaning apparatus is easily maintained and can be operated with very little training on the part of the operator. The cleaning apparatus is operated by pressurized air of the type which is usually available in most textile plants.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figures 1, 2, 3, 4, 5, 6:
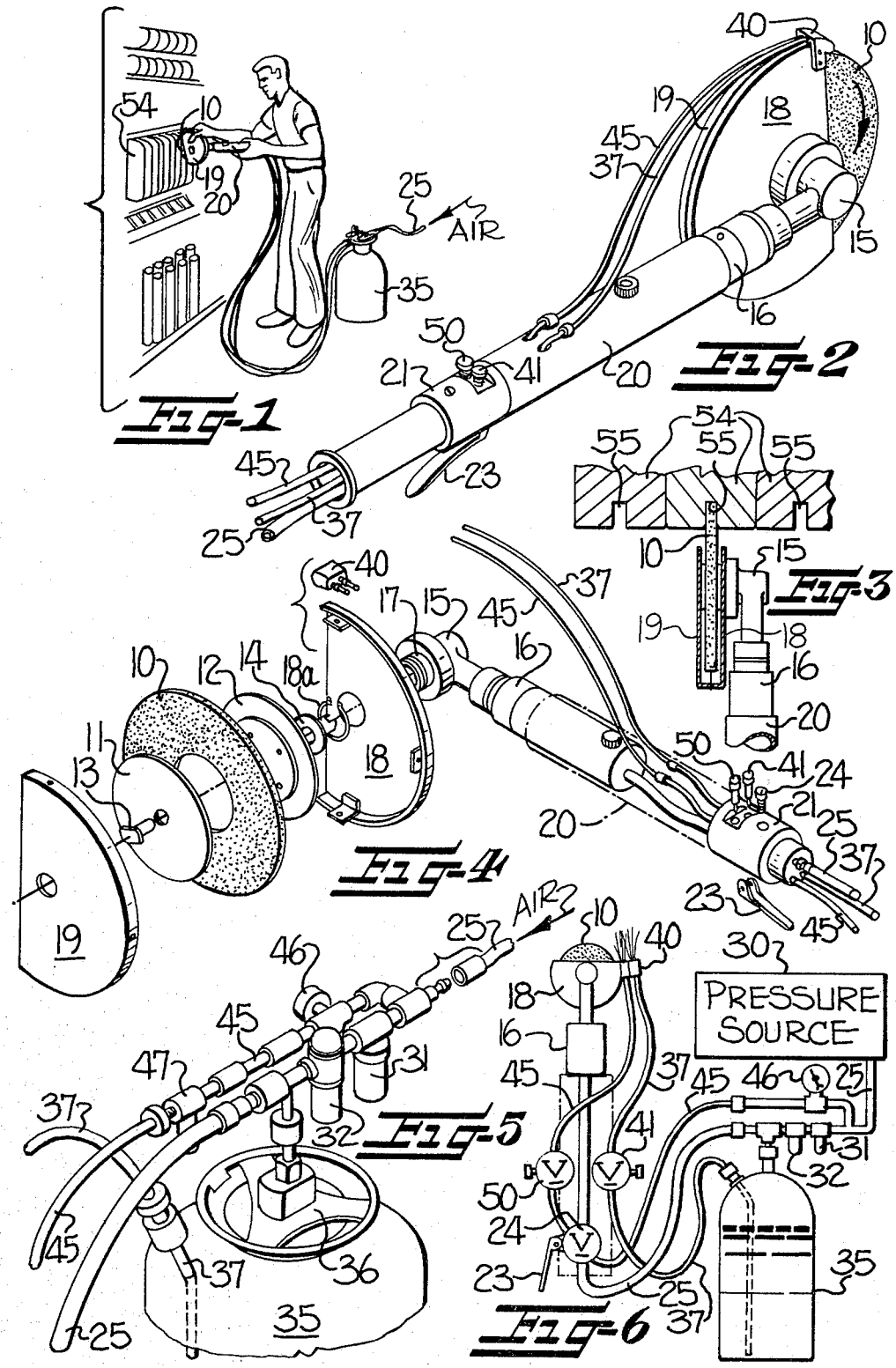
FIG. 1 is a somewhat schematic perspective view of a fragmentary portion of a yarn texturing machine which includes a yarn heater block with individual yarn heating slots at each of the yarn processing stations and illustrating an operator cleaning one of the slots with the cleaning apparatus of the present invention.
FIG. 2 is an isometric view of the handle and abrasion wheel portion of the present apparatus.
FIG. 3 is a somewhat schematic sectional plan view through a portion of the heater block and illustrating the abrasion wheel being positioned in one of the yarn heater slots.
FIG. 4 is an exploded isometric view of the abrasion wheel and the handle with the cover being shown in phantom lines.
FIG. 5 is an isometric view of the upper portion of the liquid supply tank and illustrating the manner in which the air pressure is connected thereto.
FIG. 6 is a schematic diagram illustrating the manner in which the air under pressure is directed throughout the system to feed the liquid from the tank and to rotate the abrasion wheel.

The cleaning apparatus includes an abrasion wheel or disc 10. The outer peripheral surface of the abrasion wheel 10 is contoured to match the configuration and to fit into the yarn heater slot of the particular yarn texturing machine with which it is to be used. The wheel is preferably formed of a nonwoven web of synthetic fibers which are adhesively bonded together and is sometimes laced with abrasive minerals. Such products are known as three-dimensional abrasives.

As illustrated in FIG. 4, the abrasion wheel 10 is supported for rotation between a pair of drive flanges 11, 12. A spindle nut 13 extends through the flanges 11, 12 and a spindle adapter 14 to drivingly connect the wheel 10 to the drive of a right-angle adapter 15 of an air motor 16. The right-angle adapter 15 has a hub portion 17 adapted to receive an inside cover or guard plate 18. The inside cover plate 18 is retained on the hub 17 by a lock or retaining ring 18*a*. An outside cover or guard plate 19 is suitably attached to the inside cover plate 18 to cover the major peripheral portion of the abrasion wheel 10. The cover plates 18, 19 are supported for pivotal movement on handle means, to be presently described. The air motor 16 is of a conventional and well-known type and is rotated by air pressure to impart rotation to the abrasion wheel 10, and rotation of the wheel 10 is controlled by the operator, in a manner to be presently described.

The forward end of a tubular handle 20, shown in phantom lines in FIG. 4, surrounds and is fixed to the air motor 16 and its rearmost end supports a valve housing 21. The operator controls rotation of the abrasion wheel 10 by means of a valve lever 23 which is hingedly supported on the lower portion of the valve housing 21 and controls the operation of a valve 24 (FIG. 6) interposed in an air supply line 25, the forward end of which is connected to the air motor 16 (FIG. 4).

The air supply line 25 extends from the valve housing 21 and to a suitable source of compressed air, as indicated at 30 in FIG. 6. The air supply line 25 is suitably connected, as by a quick disconnect connector to the cleaning apparatus (FIG. 5) and a suitable filter unit 31 and lubricating unit 32 are supported in the air supply line 25. The air supply line 25 is also connected to a liquid supply tank 35 and through a pressure lid assembly 36.

A liquid supply line 37 is connected at one end to the liquid supply tank 35 and extends upwardly through the valve housing 21 to one side of a spray nozzle manifold 40 which is suitably mounted on the cover guards 18, 19 to direct fluid under pressure into the slot when the abrasion wheel 10 is positioned therein. A manual control valve 41 is supported in the valve housing 21 for controlling the amount of liquid which flows through the liquid supply line 37 and from the tank 35 to the spray nozzle manifold 40.

Air is also supplied to the abrasion wheel 10 by an air supply line 45 which is connected at one end (FIG. 5) to the air supply line 25. A guage and regulator 46 and a relief valve 47 are interposed in the line 45. The supply line 45 extends through the valve housing 21 and to the spray nozzle manifold 40. A manual control valve 50 is supported in the valve housing 21 and manually controls the amount of air which flows through the line 45 and to the spray nozzle manifold 40.

METHOD OF OPERATION

Before commencing the cleaning operation, the operator fills the liquid supply tank 35 with the desired amount and type of cleaning detergent and/or plain water, positions the lid assembly 36 in engaged and closed position, and connects the main air supply line 25 to the unit. The valves 41 and 50 are then manually adjusted to feed the proper amount and mixture of air and liquid to the spray nozzle manifold 40. The texturing machine is stopped but it is not necessary to drastically reduce the heat in the heater block 54 (FIG. 1).

The handle 20 and cover plates 18, 19 are then held by the operator, in the manner indicated in FIG. 1, and the trigger lever 23 is depressed to rotate the abrasion wheel 10. The operator then guides the rotating abrasion wheel 10 along the successive yarn heater slots, as indicated at 55 in FIG. 3, and pivots the cover plates 18, 19 so that the fluid stream or mist is directed into the slot 55 at the point of contact of the abrasion wheel 10. The slots 55 are shown as having straight side and bottom walls. However, most machines have slots with different configurations and the outer peripheral surface of the abrasion wheel 10 is shaped to fit into the slot. The rotating abrasion wheel 10 dislodges the accumulated deposit which has been built up on the sidewalls and bottom of the slot and also polishes and deburrs the slot.

At the same time, the fluid stream, which includes the desired mixture of air and liquid, is directed into the slot at the point of contact and in the direction of rotation of the abrasion wheel 10 to aid in removal of the dislodged deposits from the slot. It has been found that the fluid stream directed against the hot slot causes cracking of certain types of deposits and this cracking makes the deposit easier to remove by the abrasion wheel 10.

With the apparatus of the present invention, an operator can quickly and economically clean the individual slots at each yarn processing station of a textile machine without drastically reducing the heat. The present apparatus also provides uniform cleaning and polishing of the yarn heater slots without damage to the slots.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An apparatus particularly adapted for use in cleaning the yarn heaters of yarn processing machines of the type wherein each yarn passes through a relatively narrow and elongated yarn heating slot and the heating of the yarn causes deposits to be built up on the sidewalls and bottom of said slot in an amount sufficient to require periodic removal of the deposits, said apparatus comprising (a) an abrasion wheel including a configuration on the outer peripheral surface corresponding to and positioned within said slot, (b) means for rotating said abrasion wheel, (c) a cover guard surrounding a major portion of said abrasion wheel and leaving a minor portion of the outer peripheral surface of said wheel exposed, (d) handle means for manually supporting said rotating abrasion wheel and for guiding the outer peripheral surface of said abrasion wheel along said slot to dislodge the accumulated deposits and to polish said slot, and (e) fluid directing means supported adjacent said abrasion wheel for simultaneously directing a fluid stream into said slot to aid in removal of the dislodged deposits from said slot, said fluid directing means including a fluid directing jet supported on said cover guard for directing the fluid stream in the direction of rotation of said abrasion wheel, a portable liquid supply tank for containing a supply of liquid, means for directing the liquid in said supply tank to said fluid directing jet, and means for directing air under pressure into said supply tank to force the liquid from said supply tank and to said fluid directing jet.

2. An apparatus according to claim 1 wherein said means for rotating said abrasion wheel comprises an air motor supported in said handle means.

3. An apparatus according to claims 1 or 2 wherein said abrasion wheel comprises a non-woven web of synthetic fibers which are adhesively bonded together.

4. An apparatus according to claim 1 wherein said fluid directing means also includes means for directing air under pressure to said fluid directing jet.

5. An apparatus according to claim 4 including manually controlled valve means for varying the amounts of air under pressure and liquid directed to said fluid directing jet.

6. A method of cleaning the yarn heaters of yarn processing machines of the type wherein each yarn passes through a relatively narrow and elongated yarn heating slot and the heating of the yarn causes deposits to be built up on the sidewalls and bottom of the slot in an amount sufficient to require periodic removal of the deposits, said method comprising the steps of (a) guiding a rotating abrasion wheel along said slot with the outer peripheral surface of said abrasion wheel being positioned within said slot to dislodge the accumulated deposits and to polish and deburr said slot, and (b) simultaneously directing a fluid stream into said slot and in the direction of rotation of said abrasion wheel to aid in removal of the deposits from said slot.

7. A method according to claim 6 wherein the step of directing the fluid stream into said slot includes directing a predetermined mixture of liquid and air under pressure into said slot.

* * * * *